US009711876B2

(12) United States Patent
Feye-Hohmann

(10) Patent No.: US 9,711,876 B2
(45) Date of Patent: Jul. 18, 2017

(54) CLAMPING SPRING

(71) Applicant: PHOENIX CONTACT GMBH & CO. KG, Blomberg (DE)

(72) Inventor: Juergen Feye-Hohmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/917,043

(22) PCT Filed: Sep. 3, 2014

(86) PCT No.: PCT/EP2014/068667

§ 371 (c)(1),
(2) Date: Mar. 7, 2016

(87) PCT Pub. No.: WO2015/032788

PCT Pub. Date: Mar. 12, 2015

(65) Prior Publication Data

US 2016/0197418 A1 Jul. 7, 2016

(30) Foreign Application Priority Data

Sep. 9, 2013 (DE) ..... 10 2013 109 802

(51) Int. Cl.

| | |
|---|---|
| ***H01R 12/00*** | (2006.01) |
| ***H01R 12/57*** | (2011.01) |
| ***H01R 4/48*** | (2006.01) |
| ***H01R 12/75*** | (2011.01) |

(52) U.S. Cl.

CPC ..... *H01R 12/57* (2013.01); *H01R 4/4818* (2013.01); *H01R 4/4836* (2013.01); *H01R 12/75* (2013.01)

(58) Field of Classification Search

CPC .... H01R 12/57; H01R 4/4818; H01R 4/4836; H01R 12/75; H01R 12/515; H01R 4/4827; H01R 9/2666

USPC ..... 439/81

See application file for complete search history.

(56) References Cited

U.S. PATENT DOCUMENTS

| | | | | |
|---|---|---|---|---|
| 5,174,784 A | | 12/1992 | Penning | |
| 5,292,260 A | * | 3/1994 | Sinisi | H01R 12/515 439/441 |
| 6,056,585 A | * | 5/2000 | Hatakeyama | H01R 12/515 439/441 |
| 6,080,008 A | | 6/2000 | Frantz | |
| 7,351,118 B1 | | 4/2008 | Duesterhoeft et al. | |
| 7,581,965 B1 | | 9/2009 | Upasani et al. | |

(Continued)

FOREIGN PATENT DOCUMENTS

| | | |
|---|---|---|
| DE | 3817706 A1 | 12/1988 |
| DE | 8907151 U1 | 8/1989 |

(Continued)

*Primary Examiner* — Jean F Duverne

(74) *Attorney, Agent, or Firm* — Leydig, Voit & Mayer, Ltd.

(57) ABSTRACT

A clamping spring for mounting on a circuit board includes a spring leg for contacting a conductor in a clamped manner, the spring leg having an actuating element for stopping clamping, a contact region for contacting the circuit board; and a guide element disposed in relation to the spring leg such that a tool for actuating the actuating element can be inserted between the guide element and the spring leg, wherein the clamping spring is designed in one piece.

8 Claims, 3 Drawing Sheets

(56) References Cited

U.S. PATENT DOCUMENTS

| | | | | |
|---|---|---|---|---|
| 7,896,686 | B2 * | 3/2011 | Hoppe | H01R 4/4827 439/441 |
| 2002/0187670 | A1 * | 12/2002 | Cisey | H01R 9/2666 439/441 |
| 2008/0045053 | A1 | 2/2008 | Stadler et al. | |
| 2010/0279523 | A1 | 11/2010 | Schwettmann et al. | |
| 2011/0250775 | A1 | 10/2011 | Bies et al. | |

FOREIGN PATENT DOCUMENTS

| | | | |
|---|---|---|---|
| DE | 2001093592 | A | 4/2001 |
| DE | 29824519 | U1 | 7/2001 |
| DE | 10153170 | C1 | 2/2003 |
| DE | 102006028814 | A1 | 12/2007 |
| DE | 102007035336 | B3 | 2/2009 |
| DE | 202009006254 | U1 | 7/2009 |
| DE | 102010014143 | A1 | 10/2011 |
| DE | 202012103688 | U1 | 11/2012 |
| DE | 102011079318 | A1 | 1/2013 |

* cited by examiner

CLAMPING SPRING

CROSS REFERENCE TO RELATED APPLICATIONS

This application is a U.S. National Stage Application under 35 U.S.C. §371 of International Application No. PCT/EP2014/068667 filed on Sep. 3, 2014, and claims benefit to German Patent Application No. DE 10 2013 109 802.9 filed on Sep. 9, 2013. The International Application was published in German on Mar. 12, 2015 as WO 2015/032788 A1 under PCT Article 21(2).

FIELD

The present invention relates to a clamping spring for mounting on a circuit board and to a circuit board comprising a conductor track and a clamping spring of this kind.

BACKGROUND

Nowadays it is usual, when equipping circuit boards, that small and very small components are automatically picked and adhesively bonded to the circuit board, in order to then be soldered to the circuit board in a subsequent process.

It is often not possible to integrate large connection terminals in this process and said terminals are later hand soldered to the circuit board. This step is associated with high costs. It is often merely necessary to connect a single conductor to a conductor track of the circuit board or to a device, meaning that the automatic method developed for the connection terminals cannot be carried out efficiently.

DE 20 2009 006 254 U1 discloses a terminal, which is attached to a circuit board in the manner of an expansion bolt. A corresponding plated-through hole is located on the circuit board, the diameter of said hole being adapted to the expansion bolt. However, attaching the conductor is complex. In particular, detaching the terminal from the conductor is associated with high complexity.

Moreover, DE 101 53 170 A1 discloses a cage spring comprising soldering legs, which can be mounted on a circuit board. In this case, the soldering legs facilitate the positioning of the cage spring on the circuit board. The cage spring has been proven in practice and it is easily possible to attach said spring to the circuit board. However, in practice it has proved desirable to improve the handling of the spring for assembling and disassembling the conductor. An additional guide must often be provided for opening the spring, which is associated with additional outlay.

SUMMARY

In an embodiment, the present invention provides a clamping spring for mounting on a circuit board including a spring leg for contacting a conductor in a clamped manner, the spring leg having an actuating element for stopping clamping, a contact region for contacting the circuit board; and a guide element disposed in relation to the spring leg such that a tool for actuating the actuating element can be inserted between the guide element and the spring leg, wherein the clamping spring is configured as one piece.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
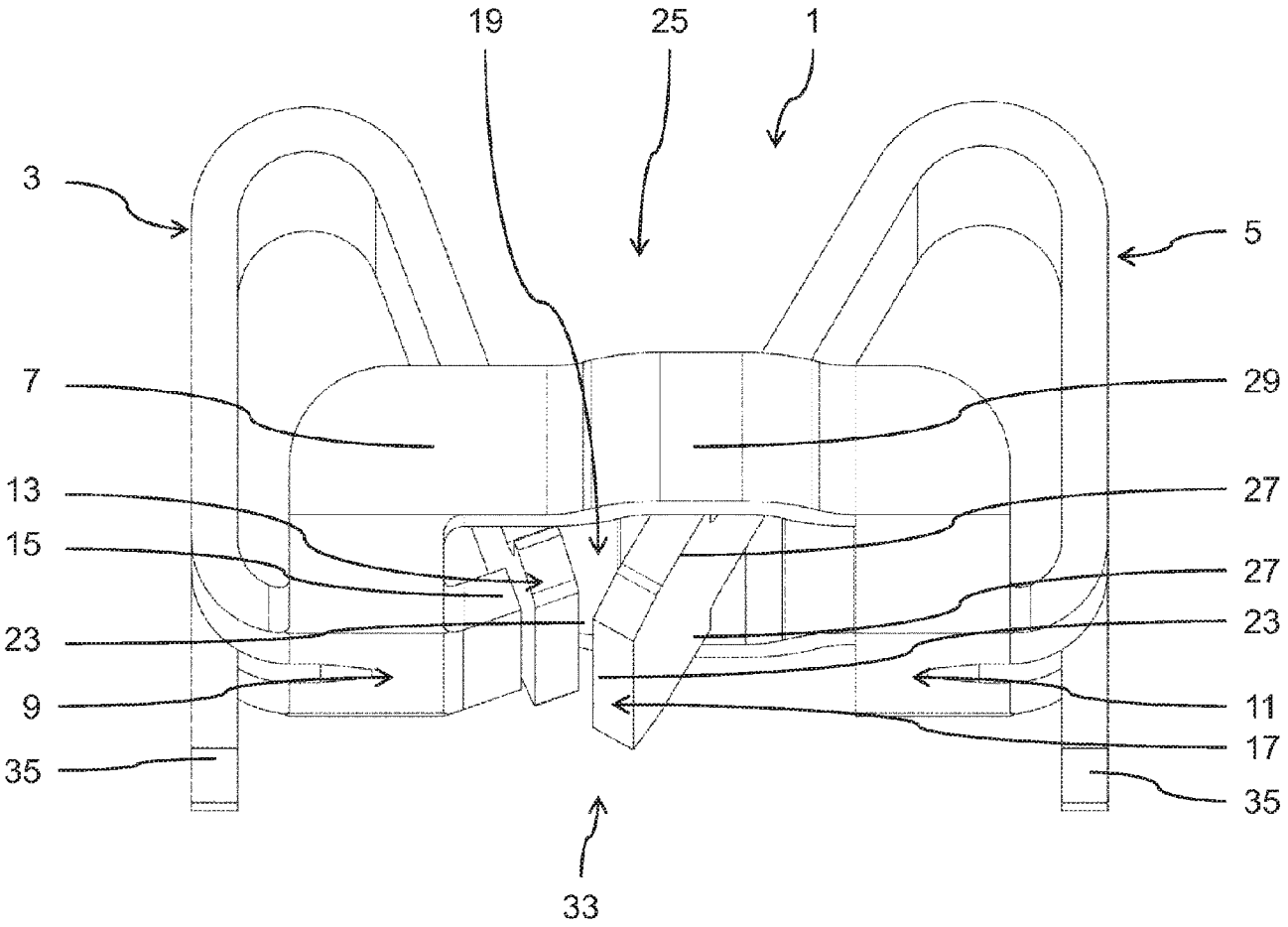
FIG. 1 is a perspective side view from below of a clamping spring according to a first embodiment of the invention.

An embodiment of the invention provides a clamping spring of the above-mentioned type which has a simple construction, is simple to produce, and allows simple handling for inserting and/or removing a conductor.

According to an embodiment of the invention, a clamping spring is thus provided for mounting on a circuit board. The clamping spring comprises a spring leg for contacting a conductor in a clamped manner, a contact region for contacting the circuit board, wherein the clamping spring is designed in one piece, the spring leg has an actuating element for stopping the clamping, and the clamping spring has a guide element which is arranged such that a tool for actuating the actuating element can be inserted between the spring leg and the guide element.

In addition, according to an embodiment of the invention, a circuit board comprising a conductor track and a clamping spring as specified above is provided, wherein the clamping spring is electrically conductively connected to the conductor track.

According to an embodiment of the invention, the clamping spring is designed such that it can itself guide a tool to actuate the spring leg. The spring leg can thus be reliably actuated and the tool is prevented from slipping during actuation. Additional components for guiding the tool are not required. At the same time, producing the clamping spring is simple since it is designed in one piece. Attaching the clamping spring can be easily carried out by soldering a region of the clamping spring to the circuit board. For this purpose, the clamping spring is positioned on a conductor track of the circuit board and soldered thereto. A region of the clamping spring having an even contact surface is preferably positioned on the circuit board in order to be able to reliably carry out the soldering process. The clamping spring is preferably applied to the circuit board in a SMT solder process. In this case, a soldering paste is applied to the circuit board, and the clamping spring is positioned on the soldering paste so that the clamping spring adheres to the circuit board. In a subsequent soldering step, for example in a soldering tunnel, the soldered connection between the clamping spring and the circuit board is produced, the soldering paste providing the solder for the soldering.

In addition, the clamping spring can overlap regions of the circuit board in a connection region, which regions have no conductor tracks, or the dimensions of the conductor track can be larger than the dimensions of the clamping spring in the connection region. The configuration of the circuit board having conductor tracks and optional additional components is in principle arbitrary and has no influence on the clamping spring and the connection thereof to the circuit board. The clamping can be carried out in different ways, it being possible to form a counter clamping element for clamping the conductor, for example by means of a stop, against which the inserted conductor can be pressed by means of the clamping leg.

The clamping spring is made of an electrically conductive material. The clamping spring preferably comprises a steel material, particularly preferably spring steel, making simple and reliable clamping of the conductor possible. It is particularly preferable for the clamping spring to have a surface coating made of a good electrically conductive material, so that the clamping spring has good electrical conductivity. The surface coating is preferably a galvanically applied copper layer, which is particularly preferably tin-plated. The clamping spring is thus easily to solder, for example in a reflow process. Alternatively, the clamping spring is made of bronze.

The spring leg is preferably arranged and designed such that it comprises a clamping edge for contacting the inserted conductor. Particularly preferably, the spring leg is arranged such that it is at an inclined angle relative to the insertion direction of the conductor. Therefore the contact can be formed for example by a clamping edge at the free end of said leg. The spring leg is further preferably arranged and designed such that it forms a run-off slope for the conductor. Inserting the conductor is thereby simplified. An internal arrangement of the free end of the spring leg can facilitate the guiding of the tool.

In addition, a housing can be mounted above the clamping spring in order to achieve protection from electric shocks. The housing is preferably put onto the clamping spring after soldering.

In an advantageous embodiment of the invention, the actuating element is arranged at a free end of the spring leg. At the free end, the leverage of the tool is particularly great, as a result of which the actuation using the tool is made easier. In addition, the spring leg can itself function as the guide for the tool.

In an advantageous embodiment of the invention, the actuating element is arranged on the spring leg at the side region thereof transversely to the spring direction thereof. The spring leg can thus function for example as a run-off slope, without this function being impaired by the tool for example. The actuation can also take place in a side region in such a way as to ensure equally simple actuation by the tool. An adverse effect due to different positions of the spring leg, for example caused by an inserted conductor, is prevented. It is particularly preferable for an actuating element to be arranged on each side region of the spring leg. A particular orientation of the clamping spring in relation to the actuation is thus not required.

In an advantageous embodiment of the invention, the clamping spring comprises a fixed clamping leg, it being possible to clamp the conductor between the clamping leg and the spring leg. The clamping leg thus functions as a counter clamping element, against which the inserted conductor is pressed by means of the spring leg. The clamping leg is preferably designed and arranged such that it comprises a clamping edge for clamping the inserted conductor.

The clamping edge is preferably formed by a free end of the clamping leg. It is particularly preferable for the clamping spring to have a stop element that forms a stop for the clamping leg. The clamping leg thus can be fixed in position such that it forms a fixed counter clamping element, even if the clamping spring is made of a resilient material. It is particularly preferable for the clamping leg to be prestressed against the stop element.

In an advantageous embodiment of the invention, the clamping leg forms an insertion chamfer for the conductor. This makes it easier to insert the conductor. Alternatively, the spring leg can also form an insertion chamfer for the conductor. Particularly preferably, both the clamping leg and the spring leg form an insertion chamfer for the conductor. The two legs can thus form an insertion funnel for example.

In an advantageous embodiment of the invention, the guide element is designed as a connection element between the clamping leg and the spring leg. The clamping spring can thus have a simple construction comprising few functional portions or components.

In an advantageous embodiment of the invention, the clamping spring comprises two guide elements which are each designed as a connection element between the clamping leg and the spring leg. The clamping leg and the spring leg can therefore be interconnected in a particularly reliable manner. The two guide elements are preferably arranged such that an insertion region for inserting the conductor is formed between the spring leg, the clamping leg and the two guide elements.

In an advantageous embodiment of the invention, the clamping spring comprises at least one soldering leg on its mounting side for positioning on the circuit board. The soldering leg can be inserted in a hole in the circuit board in order to bring about reliable positioning of the clamping spring on the circuit board. Accordingly, the circuit board having the clamping spring positioned thereon can be moved before the soldering, without the clamping spring slipping on the circuit board. The hole in the circuit board is preferably formed as a contact hole, resulting in contacting the circuit board. The contacting can occur in addition or as an alternative to the contacting by attaching the contact spring to the conductor track.

In an advantageous embodiment of the invention, the clamping spring is designed as a plate element and made by punching and bending. This makes it possible to provide a clamping spring which is simple to construct and cost-effective to produce.

Figure 2:
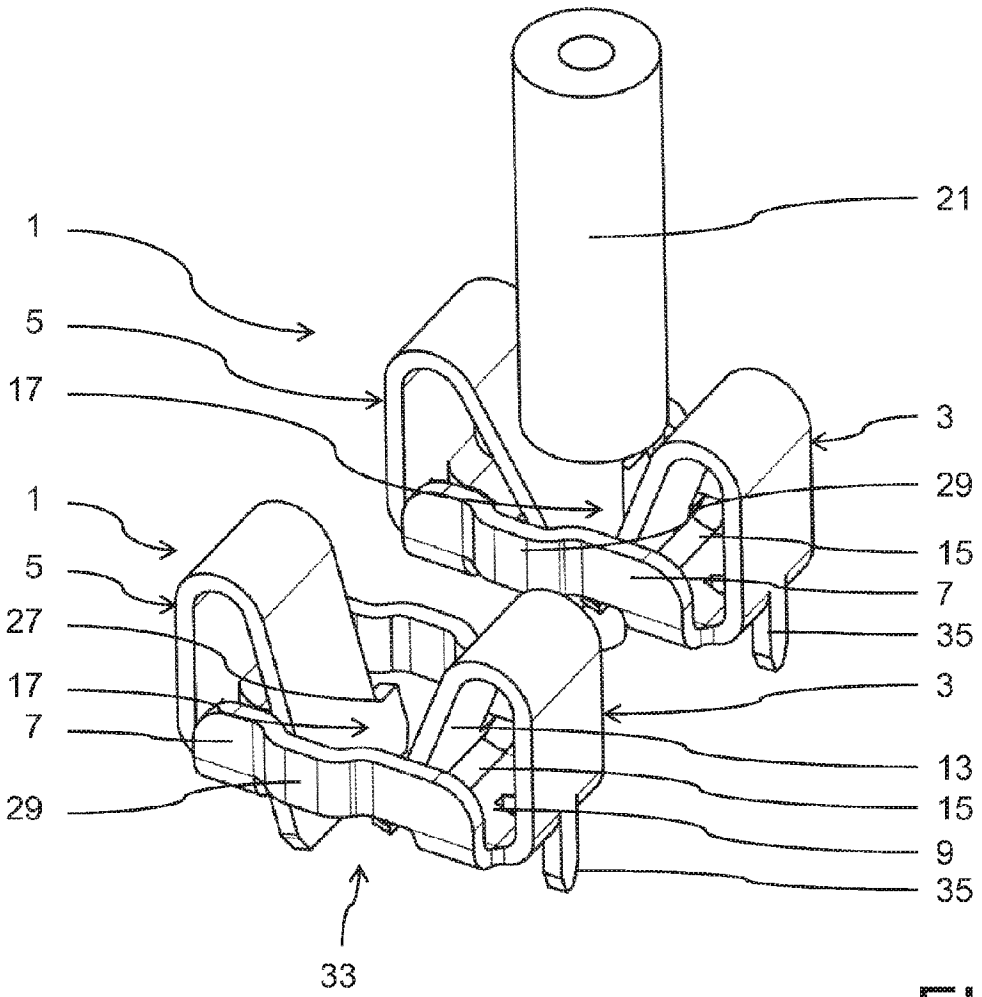
FIG. 2 shows two perspective side views from above of the clamping spring from FIG. 1, a conductor being inserted into one of the clamping springs.

FIGS. 1 and 2 show a clamping spring 1 according to the invention according to a first preferred embodiment. The clamping spring 1 is designed in one piece as a plate element made of spring steel having a galvanically applied copper coating and tin plating, and made by stamping and bending.

The clamping spring 1 comprises a fixed clamping leg 3, a spring leg 5 and two guide elements 7. The guide elements 7 are designed as connection elements which are connected to one end 9 of the clamping leg 3 and one end 11 of the spring leg 5.

The clamping leg 3 is designed as a substantially elongate plate element, which is bent in the shape of a ring such that its two ends 9, 13 come into contact with one another. As shown in detail in FIG. 1, the clamping leg 3 has a projection 15 on its retained end 9, which projection is designed as a stop element and forms a stop for the other, free end 13 of the clamping leg 3.

The spring leg 5 is also designed as a substantially elongate plate element, which is bent substantially in the shape of an open triangle such that its two ends 11, 17 do not come into contact with one another. At its free end 17, the spring leg 5 has two actuating elements 27 which are arranged on both sides transversely to the spring direction of the spring leg 5. The actuating elements 27 are designed as lateral projections.

An insertion region 19 for inserting a conductor 21 is formed between the spring leg 5, the clamping leg 3 and the two guide elements 7. As shown in FIG. 2, the conductor 21 is pressed against the clamping leg 3 in the insertion position of the spring leg 5, such that the conductor 21 simultaneously contacts the clamping spring 1 and is held therein in a clamped manner. In the process, a contact is formed along a clamping edge 23 both between the clamping leg 3 and the conductor 21 and between the spring leg 5 and the conductor 21 at the free ends 13, 17 of the respective legs 3, 5.

Both the clamping leg 3 and the spring leg 5 form an insertion chamfer for the conductor 21, by means of which in total one insertion funnel 25 is formed.

The clamping of the conductor 21 is shown in FIG. 2. The clamping spring 1 can be opened by a tool. The tool can be designed for example as a flat-blade screwdriver. The tool is inserted between the spring leg 5 and one of the guide elements 7 until the corresponding actuating element 27 is reached. For this purpose, the guide elements 7 each have a bulge 29 for receiving the tool. The spring leg 5 is elastically deformed by exerting a force on the actuating element 27, as a result of which the insertion region 19 is opened and the conductor 21 can be inserted into the insertion region 19 along the insertion funnel 25. The tool can subsequently be removed so that the spring leg 5 undergoes elastic recovery and resiliently clamps and contacts, in the manner described above, the conductor 21 between said spring leg 5 and the clamping leg 3. By reinserting the tool and exerting a force on the actuating element 27, the spring leg 5 is again elastically deformed, as a result of which the conductor 21 can be removed from the clamping spring 1.

Alternatively, the conductor can also be inserted into the clamping spring 1 without a tool. For this purpose, the conductor 21 is inserted into the insertion funnel 25 until it comes into contact with the two legs 3, 5. By further inserting the conductor 21, a force is exerted on the spring leg 5, as a result of which said leg elastically deforms and the conductor 21 can be inserted into the insertion region 17. The clamping and the contacting of the conductor 21 in the clamping spring 1 takes place automatically upon completion of the insertion process.

Figure 3:
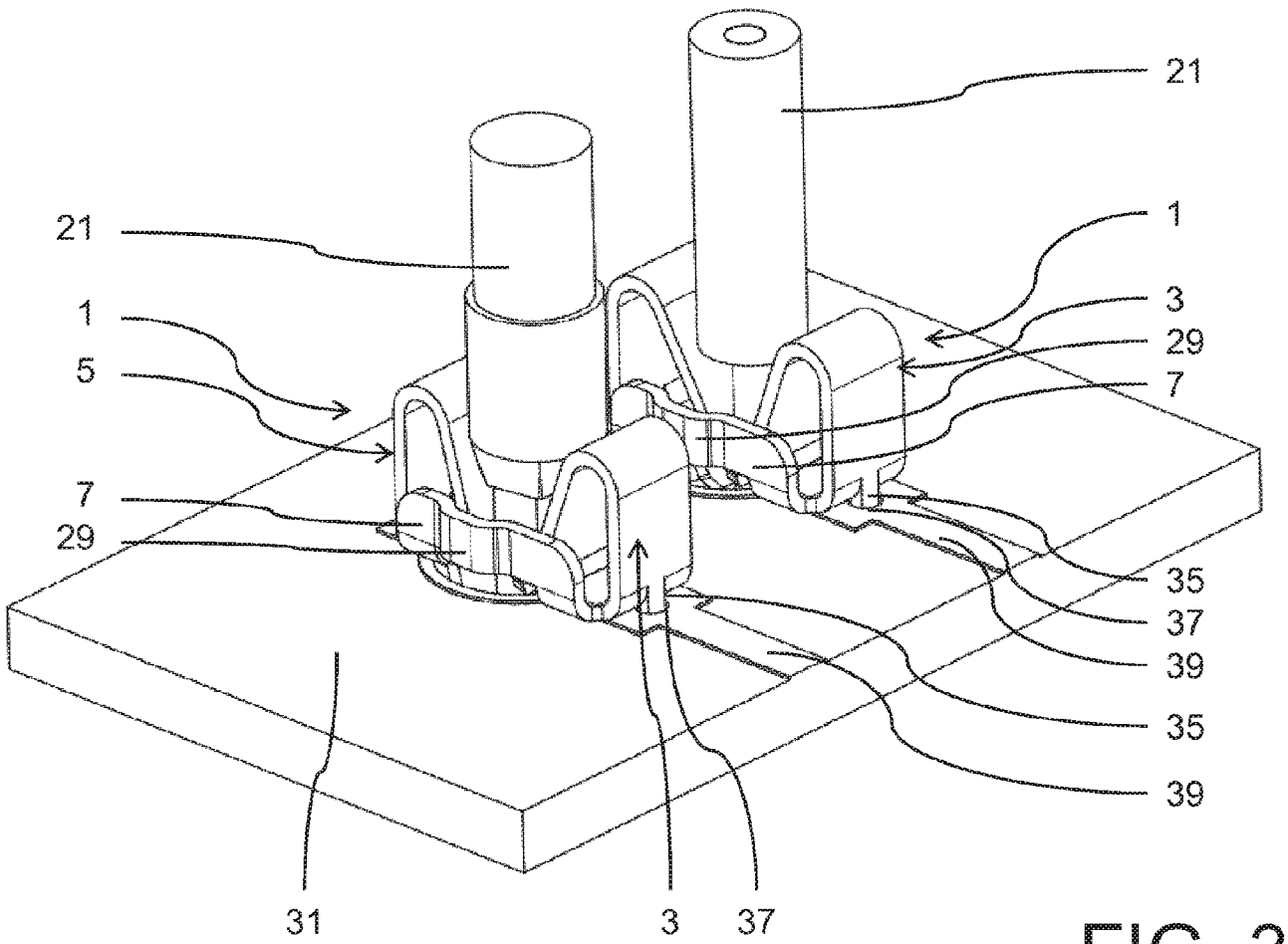
FIG. 3 is a perspective view of a circuit board comprising two clamping springs according to FIG. 1 comprising inserted conductors.

FIG. 3 shows the attachment of the clamping spring 1 on a circuit board 31. The clamping spring 1 is designed to have two soldering legs 35 on its underside 33 for the purpose of mounting, by means of which legs the clamping spring 1 is positioned in through-holes 37 in the circuit board 31. The clamping spring 1 is subsequently soldered, on its underside 33, to a conductor track 39 of the circuit hoard 31, as a result of which a mechanical and electrically conductive connection of the clamping spring 1 to the conductor track 39 is formed. The underside 33 thus forms a contact region of the clamping spring 1.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Clamping spring 1
Clamping leg 3
Spring leg 5
Guide element, connection element 7
Retained end (clamping leg) 9
Retained end (spring leg) 11
Free end (clamping leg) 13
Stop element (projection) 15
Free end (spring leg) 17
Insertion region 19
Conductor 21
Clamping edge 23
Insertion funnel 25
Actuating element/projection 27
Bulge 29
Circuit board 31
Underside/contact region 33
Soldering leg 35
Through-hole 37
Conductor track 39

The invention claimed is:

1. A clamping spring for mounting on a circuit board, comprising:

a spring leg for contacting a conductor in a clamped manner, the spring leg having an actuating element;

a contact region for contacting the circuit board;

a fixed clamping leg disposed opposite the spring leg and forming a conductor receiving region therebetween, the conductor receiving region being configured to receive the conductor therein for clamping; and a guide element connecting the clamping leg and the spring leg at sides thereof, the guide element including a bulge forming a tool receiving region between the guide element and the spring leg, the tool receiving region configured to receive an actuating tool therein so as to displace the actuating element and move the spring leg away from the fixed clamping leg, wherein the clamping spring is configured as one piece.

2. The clamping spring according to claim 1, wherein the actuating element is arranged at a free end of the spring leg.

3. The clamping spring according to claim 1, wherein the actuating element is arranged on the spring leg at the side region thereof and transversely to a direction of the spring.

4. The clamping spring according to claim 1, wherein the clamping leg forms an insertion chamfer for the conductor.

5. The clamping spring according to claim 1, wherein the clamping spring includes two guide elements which are each configured as a connection element between the clamping leg and the spring leg.

6. The clamping spring according to claim 1, wherein the clamping spring comprises at least one soldering leg on its mounting side for positioning on the circuit board.

7. The clamping spring according to claim 1, wherein the clamping spring is configured as a plate element.

8. A circuit board comprising:

a conductor track; and a clamping spring configured as one piece, the clamping spring comprising:

a spring leg for contacting a conductor in a clamped manner, the spring leg having an actuating element;

a contact region for contacting the circuit board;

a fixed clamping leg disposed opposite the spring leg and forming a conductor receiving region therebetween, the conductor receiving region being configured to receive the conductor therein for clamping; and a guide element connecting the clamping leg and the spring leg at sides thereof, the guide element including a bulge forming a tool receiving region between the guide element and the spring leg, the tool receiving region configured to receive an actuating tool therein so as to displace the actuating element and move the spring leg away from the fixed clamping leg, wherein the clamping spring is electrically conductively connected to the conductor track.

* * * * *